United States Patent [19]

Krill et al.

[11] Patent Number: 4,688,335

[45] Date of Patent: Aug. 25, 1987

[54] APPARATUS AND METHOD FOR DRYING FIBROUS WEB MATERIAL

[75] Inventors: Wayne V. Krill, Sunnyvale, Calif.; Richard P. Taylor, Stamford, Conn.; Thomas Wong, Menlo Park, Calif.

[73] Assignee: James River Corporation of Nevada, San Francisco, Calif.

[21] Appl. No.: 830,320

[22] Filed: Feb. 18, 1986

[51] Int. Cl.[4] ..... F26B 3/32; D21F 11/00; F28D 11/02; F29B 9/28

[52] U.S. Cl. ..... 34/41; 34/115; 34/122; 162/206; 162/358; 162/359; 162/361; 162/375; 432/60; 432/228; 38/44; 165/89

[58] Field of Search ..... 162/361, 206, 375, 376, 162/359, 290, 358; 34/120, 114, 122, 41, 115; 100/93 RP; 432/60, 228; 165/89; 38/44

[56] References Cited

U.S. PATENT DOCUMENTS 2,362,947 11/1944 Sullivan ..... 38/52 X
3,919,783 11/1975 Cirrito ..... 34/115 X

*Primary Examiner*—Peter Chin
*Assistant Examiner*—Thi Dang
*Attorney, Agent, or Firm*—Stanley M. Teigland

[57] ABSTRACT

A dryer for paper and similar fibrous web materials including a dryer roll having an outer cylindrically-shaped wall, a radiant heat source within the dryer roll adapted to heat the wall substantially uniformly about the entire periphery thereof, and nip-forming means forming a pressure nip with the dryer roll.

18 Claims, 2 Drawing Figures

APPARATUS AND METHOD FOR DRYING FIBROUS WEB MATERIAL

BACKGROUND OF INVENTION

This invention relates to an apparatus and method for drying fibrous web material such as a wet paper web.

A number of systems have been devised for drying paper webs and the like, perhaps the most common being those wherein the web is pressed or otherwise applied to heated rolls such as a Yankee dryer which is a steam heated cylinder of large diameter.

U.S. Pat. No. 4,324,613 issued to Wahren discloses a variation of the heated cylinder approach wherein drying of a web is effected by transferring heat very rapidly, directly to a web under high pressure. Heat is directly supplied to the outer surface of a roll and the heated surface is then pressed under high pressure against the moist web to consolidate and dry the web.

U.S. Pat. No. 4,324,613 specifically suggests that the external heating of the roll may be accomplished through the use of liquid, pulverized, or gaseous fuel.

The system of U.S. Pat. No. 4,324,613 utilizes a technique known in the art as "impulse drying" wherein temperatures and rates of thermal energy flow used for the heated roll are so high as to cause a very rapid, violent and almost explosive generation of steam to take place at the interface between the roll and the moist web. The steam thus formed tends to pass straight through the web, carrying with it any free water remaining in the cavities between the fibers of the web.

There are limitations and operational difficulties inherent in a dryer system such as that taught by U.S. Pat. No. 4,324,613 wherein heat is applied directly to the outside of a dryer roll. For example, use of an external combustion approach results in obvious environmental problems. Further, the application of heat directly to the outer surface of the dryer roll can result in deterioration or contamination of the very surface to be contacted by the paper. An exterior burner system must also be protected from water and vapor contained in the web.

Perhaps the most profound difficulties, however, result from the fact that use of an external heating source necessarily means that the dryer roll cannot be heated about its entire periphery. Thus, heat flux is not as great or effective as it would be if application of heat took place about the full peripheral area of the roll. In addition, the application of heat about its partial periphery can cause warping of the roll.

BRIEF SUMMARY OF THE INVENTION

According to the teachings of the present invention, the advantages of impulse drying are obtained without the direct application of heat to the outer surface of a dryer roll. This has been accomplished by disposing a radiant heat source within the interior of a dryer roll, said radiant heat source being of a construction and so positioned as to be adapted to apply heat to the cylindrically-shaped wall of the dryer roll substantially uniformly about the entire periphery thereof and at an intensity sufficiently great to result in the impulse drying of a wet paper web or other fibrous material pressed into engagement with said roll.

More specifically, the radiant heat source comprises a burner mounted within the interior of the dryer roll and including a cylindrically-shaped shell comprising at least one layer of ceramic fiber matrix with interstitial spaces between the fibers. The shell is coaxially disposed with respect to the dryer roll cylindrically-shaped wall.

The dryer according to the present invention further includes means for introducing a flow of air-fuel mixture into the shell and outwardly through the spaces defined by the fibers of the fiber matrix. Combustion takes place at the fiber matrix, and because such combustion is entirely within the confines of the dryer roll, waste products produced thereby are not introduced into the ambient atmosphere but instead may be safely vented to a remote location.

DETAILED DESCRIPTION

Figure 1:
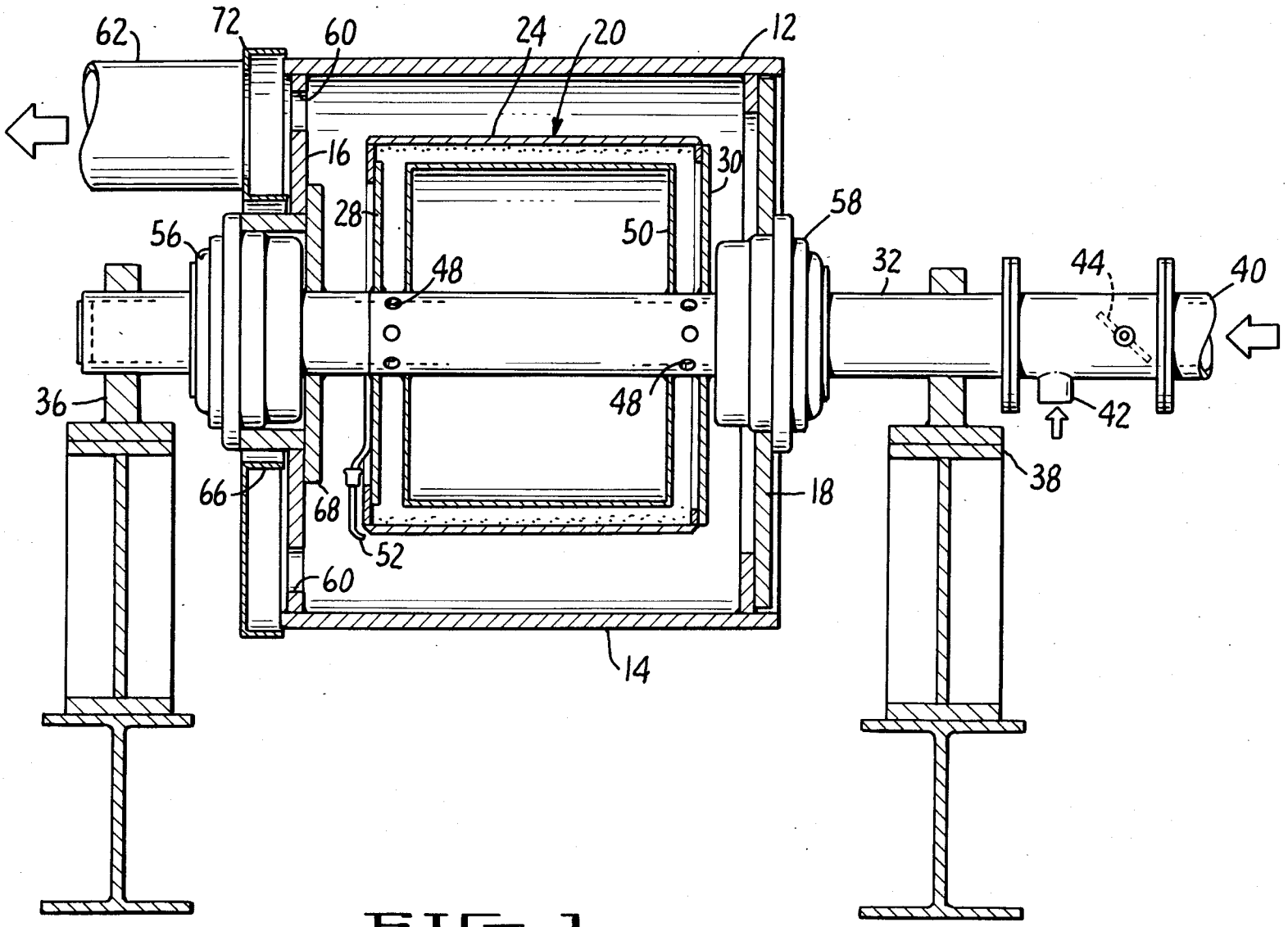
FIG. 1 is a schematic side view illustrating portions of a preferred embodiment of dryer apparatus constructed in accordance with the teachings of the present invention.

Referring to FIG. 1, the apparatus includes a dryer roll 12 including an outer cylindrically-shaped wall 14 and side walls 16, 18 cooperating with the cylindrically-shaped wall 14 to define an interior.

A radiant heat source, generally designated by reference numeral 20, is disposed within the interior of the dryer roll 12 and is adapted to heat the cylindrically-shaped wall 14 substantially uniformly about the entire periphery and length thereof. Radiant heat source 20 comprises a burner mounted within the interior of the dryer roll, said burner including a cylindrically-shaped shell 24 comprising at least one layer of ceramic fiber matrix with interstitial spaces between the fibers. Preferably the fiber matrix is of the composition described in U.S. Pat. No. 3,383,159 issued to Smith and U.S. Pat. No. 4,519,770 issued to Kesselring et al., both patents being hereby incorporated by reference.

As generally disclosed in the Smith and Kesselring et al. patents, the preferred fibers are inorganic and are composed of substantial portions of both alumina and silica. Other fibers that can be employed are such inorganic fibers as quartz fibers, vitreous silica fibers, and other generally available ceramic fibers. Powdered aluminum is preferably added to the fibers in slurry form prior to formation of the shell.

Affixed to shell 24 are solid endplates 28, 30. In turn, endplates 28, 30 are secured to tubular element 32. The shell 24 is coaxially disposed with respect to the dryer roll cylindrically-shaped wall 14. Support members 36, 38 support tubular element 32. The tubular element defines an inlet 40 for receiving air and a fuel inlet 42 for introducing a suitable fuel, such as natural gas, into the interior of the tubular element. A control vane 44 may be employed to adjust the air-fuel mix as desired.

The pressurized air-fuel mix exits tubular element 32 through apertures 48 communicating with the interior of the burner in a confined space defined by the ceramic fiber matrix shell, the endplates, and a solid centerbody 50 welded or otherwise secured to the tubular element. The pressurized air-fuel mixture then passes through the fibers of the matrix and is ignited at the shell 24 to produce heat, primarily radiant heat. A pilot device 52 may be employed if desired to ignite the mixture. The centerbody serves the function of taking up void volume within the shell and endplates to restrict the air-fuel mixture to a small space. The centerbody serves to maintain high-velocity flow of the reactants to the burner and minimizes the possibility of harmful flashback.

Dryer roll 12 is freely rotatably mounted on tubular element 32 by conventional bearings of any suitable type supported by the tubular element. Protective means in the form of bearing housings 56, 58 are disposed about the bearings proper to protect the bearings from heat generated by the burner. The exhaust gases produced by the burner are exhausted into a hood 72 through portholes 60 formed in side wall 16. The exhaust gases passing through the portholes and hood on their way to an exhaust conduit 62 would normally impinge upon bearing housing 56. Therefore, it is advisable for the purpose of protecting the bearing within housing 56 to deflect combustion products produced by the burner away from the housing. This is accomplished by disposing a baffle 66 about the housing. Also, it should be noted that housing 56 differs from housing 58 in that it includes a supplemental outer housing 68 to further protect the bearing from the hot combustion by-products vented around housing 56 and through the exhaust conduit 62. The passage of the heated gasses from the portholes 60 to the exhaust conduit 62 is thus confined to an annular space defined by the hood 72 to which the exhaust conduit is connected, sidewall 16 and baffle 66.

Figure 2:
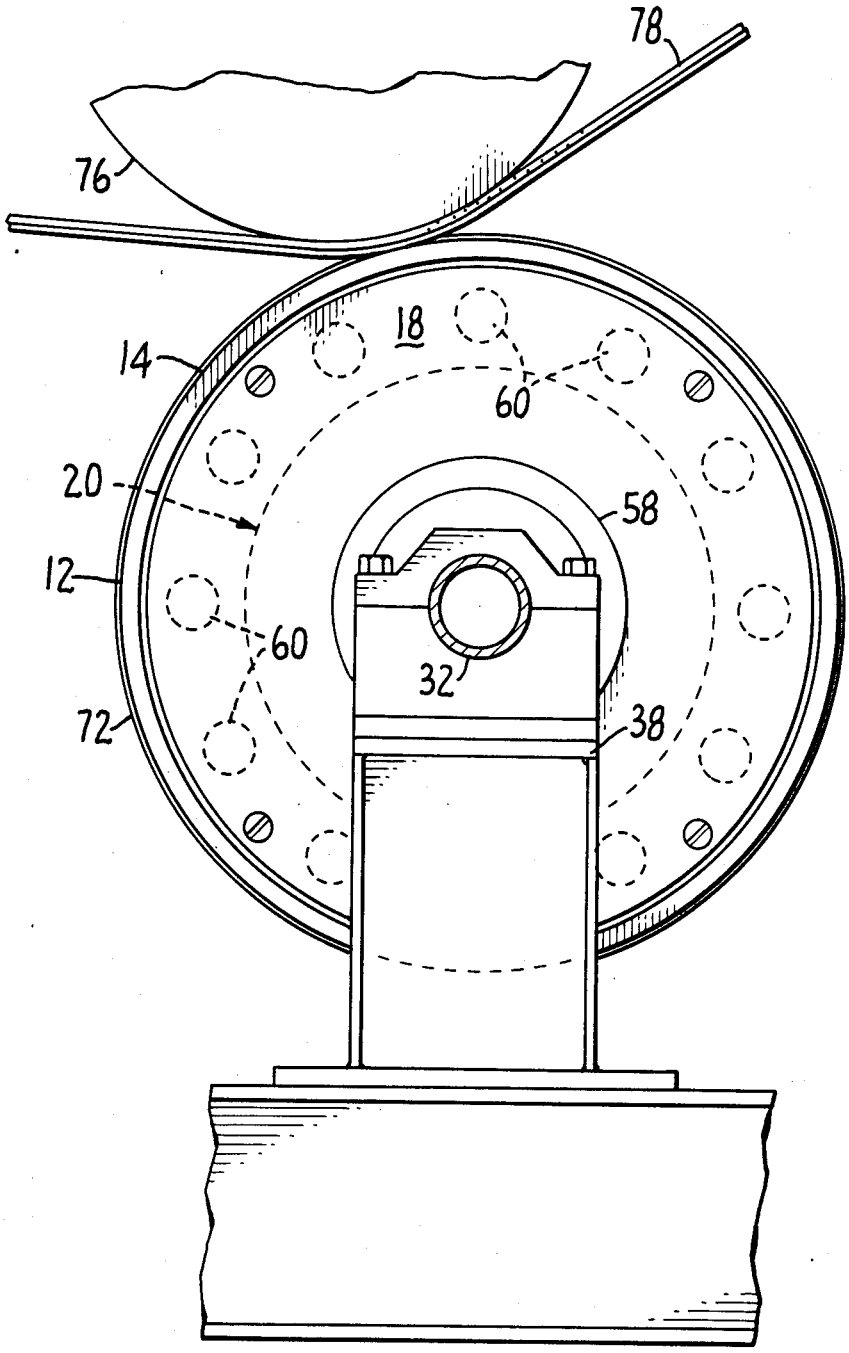
FIG. 2 is a schematic end view of the dryer roll of the preferred embodiment in operative association with other elements of the apparatus.

As stated above, dryer roll 12 is mounted for freely rotatable movement. As shown in FIG. 2, the dryer roll is rotated by nip-forming means in the form of a driven rotatable press roll 76 urged toward cylindrically-shaped wall 14 at a high roll load pressure. A felt 78 is disposed between the dryer roll 12 and the press roll 76 with the web material to be dryed being sandwiched between the felt and the cylindrically-shaped wall 14 of the dryer roll.

Radiant heat source 20 substantially uniformly heats the cylindrically-shaped wall 14 to a temperature within the range of from about 600° F. to about 800° F. Due to this very high temperature, there is very rapid generation of steam in the press nip between the rolls. The steam thus formed tends to pass straight through the web, carrying with it any free water remaining in the cavities between the fibers of the web. This moisture is absorbed by the felt to a significant degree.

The paper preferably is retained on the felt after passing through the nip. In any event, the paper is to be removed from the dryer roll. The generation of steam at the dryer roll-web interface may be adequate to accomplish this. If desired or necessary, a conventional doctor blade may be employed to effect web removal.

We claim:

1. Apparatus for drying fibrous web material comprising:

a dryer roll mounted for rotatable movement, said dryer roll including an outer cylindrically-shaped wall and side walls cooperating with said cylindrically-shaped wall to define an interior;

a radiant heat source disposed within the interior of said dryer roll and adapted to heat said cylindrically-shaped wall substantially uniformly about the entire periphery thereof, said radiant heat source comprising a burner mounted within the interior of said dryer roll, said burner including a cylindrically-shaped shell comprising at least one layer of ceramic fiber matrix with interstitial spaces between the fibers, said shell being coaxially disposed with respect to said dryer roll cylindrically-shaped wall;

means for introducing a flow of air-fuel mixture into the shell and outwardly through the spaces defined by the fibers of the fiber matrix whereby combustion takes place at the fiber matrix; and nip forming means forming a pressure nip with said dryer roll, said nip adapted to accommodate web material to be dried.

2. The dryer according to claim 1 wherein said nip forming means includes a driven rotatable press roll urged toward said cylindrically-shaped wall at a predetermined roll load pressure, said dryer roll being freely rotatably mounted whereby said dryer roll is driven by said press roll.

3. The dryer according to claim 2 wherein a felt is disposed between said dryer roll and said press roll, the web material dried by said dryer being sandwiched between said felt and the cylindrically-shaped wall of said dryer roll.

4. The dryer according to claim 3 wherein said radiant heat source substantially uniformly heats said cylindrically-shaped wall to a temperature within the range of from about 600° F. to about 800° F.

5. The dryer according to claim 1 wherein said dryer roll and said burner are mounted coaxially on a tubular element, said tubular element defining at least one inlet for receiving air and fuel and at least one outlet within said shell for delivering an air-fuel mixture to said shell.

6. The dryer according to claim 5 wherein a centerbody is disposed within said shell to define a confined space between said centerbody and said ceramic fiber matrix, said outlet defined by said tubular element being in direct communication with said confined space.

7. The dryer according to claim 1 wherein a side wall of said dryer roll defines an outlet for combustion products produced by said burner.

8. The dryer according to claim 5 wherein said dryer roll is rotatably mounted on bearings supported by said tubular element.

9. The dryer according to claim 8 wherein protective means is disposed around at least one of said bearings to protect said at least one bearing from heat generated by said burner.

10. The dryer according to claim 9 wherein said protective means includes a bearing housing and a baffle disposed about said housing to deflect combustion products produced by said burner away from said housing.

11. A method of drying fibrous web material, comprising the steps of:

forming a press nip between a dryer roll having a cylindrically-shaped wall defining an interior and a press roll;

passing web material through said nip by rotating said rolls;

positioning a radiant heat source within said dryer roll interior, said radiant heat source including a cylindrically-shaped shell comprising at least one layer of ceramic fiber matrix with interstitial spaces between the fibers, said shell being coaxially positioned relative to said dryer roll cylindrically-shaped wall, introducing a flow of air-fuel mixture into the shell and flowing the mixture outwardly through the spaces defined by the fibers of the fiber matrix; and energizing said radiant heat source by igniting the air-fuel mixture, with combustion taking place at the fiber matrix, to heat said cylindrically-shaped wall substantially uniformly about the entire periphery thereof to at least partially dry the web material passing through said nip.

12. The method according to claim 11 wherein said dryer roll is driven by said press roll.

13. The method according to claim 11 including the additional step of disposing a felt between said dryer roll and said press roll, the web material dried by said dryer being sandwiched between said felt and the cylindrically-shaped wall of said dryer roll.

14. The method according to claim 11 wherein said radiant heat source substantially uniformly heats said cylindrically-shaped wall to a temperature within the range of from about 600° F. to about 800° F.

15. The method according to claim 11 including the step of coaxially mounting the shell and the dryer roll on a tubular element, said tubular element defining at least one inlet and at least one outlet, disposing said outlet within said shell, and flowing said air-fuel mixture from said inlet within said tubular element and out of said shell.

16. The method of claim 15 including the step of defining a confined space between a centerbody and said ceramic fiber matrix, said outlet defined by said tubular element being placed in direct communication with said confined space.

17. The method according to claim 11 wherein the dryer roll includes side walls and including the additional step of venting combustion products produced by said radiant heat source through an outlet formed in a side wall.

18. The method according to claim 11 wherein said dryer roll is rotatably mounted on bearings, said method including the additional step of positioning a baffle adjacent to at least one of said bearings to shield said at least one bearing from heat generated by said radiant heat source.

* * * * *